United States Patent [19]

Davis

[11] 4,360,069

[45] Nov. 23, 1982

[54] DIAMOND DRILL BITS

[76] Inventor: Kenneth Davis, P.O. Box 7906, Midland, Tex. 79701

[21] Appl. No.: 170,901

[22] Filed: Jul. 21, 1980

[51] Int. Cl.[3] ..... F21B 10/56

[52] U.S. Cl. ..... 175/393; 175/410

[58] Field of Search ..... 175/393, 410, 329

[56] References Cited

U.S. PATENT DOCUMENTS

| | | | |
|---|---|---|---|
| 2,693,938 | 11/1954 | Roberts | 175/410 |
| 3,071,201 | 1/1963 | Phipps | 175/410 |
| 3,542,142 | 11/1970 | Hasiba | 175/410 |
| 3,645,346 | 2/1972 | Miller | 175/393 |
| 4,083,417 | 4/1978 | Arnold | 175/393 |
| 4,098,363 | 7/1978 | Rohde et al. | 175/329 |
| 4,246,977 | 1/1981 | Allen | 175/393 |

*Primary Examiner*—James A. Leppink

*Attorney, Agent, or Firm*—Marcus L. Bates

[57] ABSTRACT

A drill bit having a lower formation engaging face thereon and a plurality of radially spaced apart slots which communicate the face with an upper reduced part of the bit body so that drilling fluid can be returned to the surface of the earth. The bit has an internal counterbore which terminates short of the face and forms a passageway through which drilling fluid can flow. A plurality of radially spaced apart lateral passageways communicate the axial counterbore with the slots. A nozzle passageway communicates the face of the bit with the outer marginal end of the lateral passageways, and the lateral passageways are plugged adjacent to the slots. A nozzle is placed within the outer marginal end of the nozzle passageways. Drilling fluid is forced to flow down through the axial counterbore, and through the nozzles which are affixed to the face of the bit. This arrangement of the drilling fluid flow passageway enables the nozzles to be positioned in the most optimum manner for maintaining the cutters of the bit in a clean and efficient cutting condition. This described arrangement of the passageways and nozzles also enables the cutters to be arranged in the most optimum pattern for penetrating downhole formations.

4 Claims, 6 Drawing Figures

DIAMOND DRILL BITS

BACKGROUND OF THE INVENTION

Drill bits having polycrystalline diamond cutters have reduced the cost of fabricating diamond bits. The cutters comprise diamond particles bonded to a support base member, and the support base member is fitted into the lowermost face of the drill bit, with the face of the diamond cutter being orientated respective to the bit face so that optimum penetration is achieved. During the drilling process, it is necessary to cool and clean the face of the bit, or otherwise the cutters will not properly perform; and furthermore, they will abraid away more rapidly unless adequate cooling and cleaning is provided to the bit.

During the drilling of a borehole with a diamond cutter drill bit, it is customary to circulate drilling fluid, such as drilling mud or air, down through the drill string and through an axial passageway formed within the drill bit. The passageway is connected to provide both drilling fluid at the face of the bit, thereby lubricating, cooling, and cleaning the bit; and at the same time, transfering or circulating the removed formation to the surface of the earth.

In order to achieve a suitable cleaning and cooling action for the bit, it is desirable to provide a plurality of outlets at the bit face in order to maintain each individual diamond cutter in proper operating condition. Therefore, the passageways leading to the outlets at the face of the bit are usually drilled at an angle respective to the longitudinal axial centerline of the bit body. This arrangement of the outlets result in drilling fluid exiting the bit such that the fluid is usually directed radially outwardly away from the bit face, which is not an optimum design expedient.

It would, therefore, be desirable to be able to provide the drilling fluid outlet at the face of the bit with a nozzle, and to be able to orient the nozzles in the most optimum direction respective to one another and to the diamond cutters. Such a desirable feature is the subject of the present invention.

SUMMARY OF THE INVENTION

This invention comprehends improvements in drill bits including a polycrystalline diamond cutter drill bit having a lowermost face to which there is attached a plurality of spaced diamond cutters and a plurality of spaced nozzles. The upper end portion of the drill bit is threaded in the usual manner so that the bit can be threadedly attached to a sub at the end of a drill string. An axial counterbore extends along the longitudinal axial centerline of the bit, and terminates in spaced relationship respective to the cutting face thereof. The bit has an enlargement at the lower marginal end thereof, and a plurality of slots extend from the bit face towards the threaded end of the bit so that drilling fluid, along with the formation cuttings, can be returned uphole. A plurality of lateral passageways extend from some of the slots into communication with the axial counterbore. The outer end portion of each lateral passageway is plugged. A nozzle passageway extends from the face of the bit, and terminates in communication with the blind lateral passageway. A nozzle is fitted into the marginal end of the nozzle passageway, with the nozzle terminating in close proximity to the cutting face.

This arrangement of the bit flow passageways forces the drilling fluid to flow from the drill string, into the counterbore, along the lateral passageways, and through the nozzle passageways, where the drilling fluid exits through the nozzles. This arrangement of passageways also enables the nozzle to be orientated respective to the diamond cutters so that the cutters each individually are maintained in a cool, clean, operating condition. Moreover, this arrangement of the nozzles enables the most optimum cutter pattern to be achieved on the face of the bit.

Accordingly, a primary object of the present invention is the provision of a diamond cutter drill bit having a plurality of cutters and nozzles arranged respective to one another so that each of the cutters are maintained in a clean and cool operating condition.

Another object of the present invention is the provision of a diamond drill bit having a passageway formed therethrough through which drilling mud can flow in a new and unobvious manner.

A further object of this invention is the provision of an improved diamond drill bit which is provided with a plurality of nozzles arranged such that the longitudinal axial centerline thereof is parallel to the axial longitudinal centerline of the drill bit.

A still further object of this invention is the provision of a unique arrangement of drill bit cutters and nozzles.

Another and still further object of this invention is the provision of an improved method by which the flow passageways through a diamond drill bit may be formed in order to orientate the nozzles thereof in the most optimum manner.

Still another object of this invention is the provision of a combination comprising a diamond cutter drill bit having nozzles, cutters, and flow passageways arranged in an optimum configuration.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
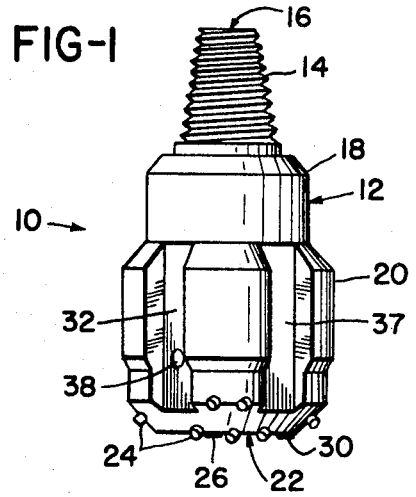
FIG. 1 sets forth a perspective, side view of a diamond drill bit made in accordance with the present invention.
Figure 2:
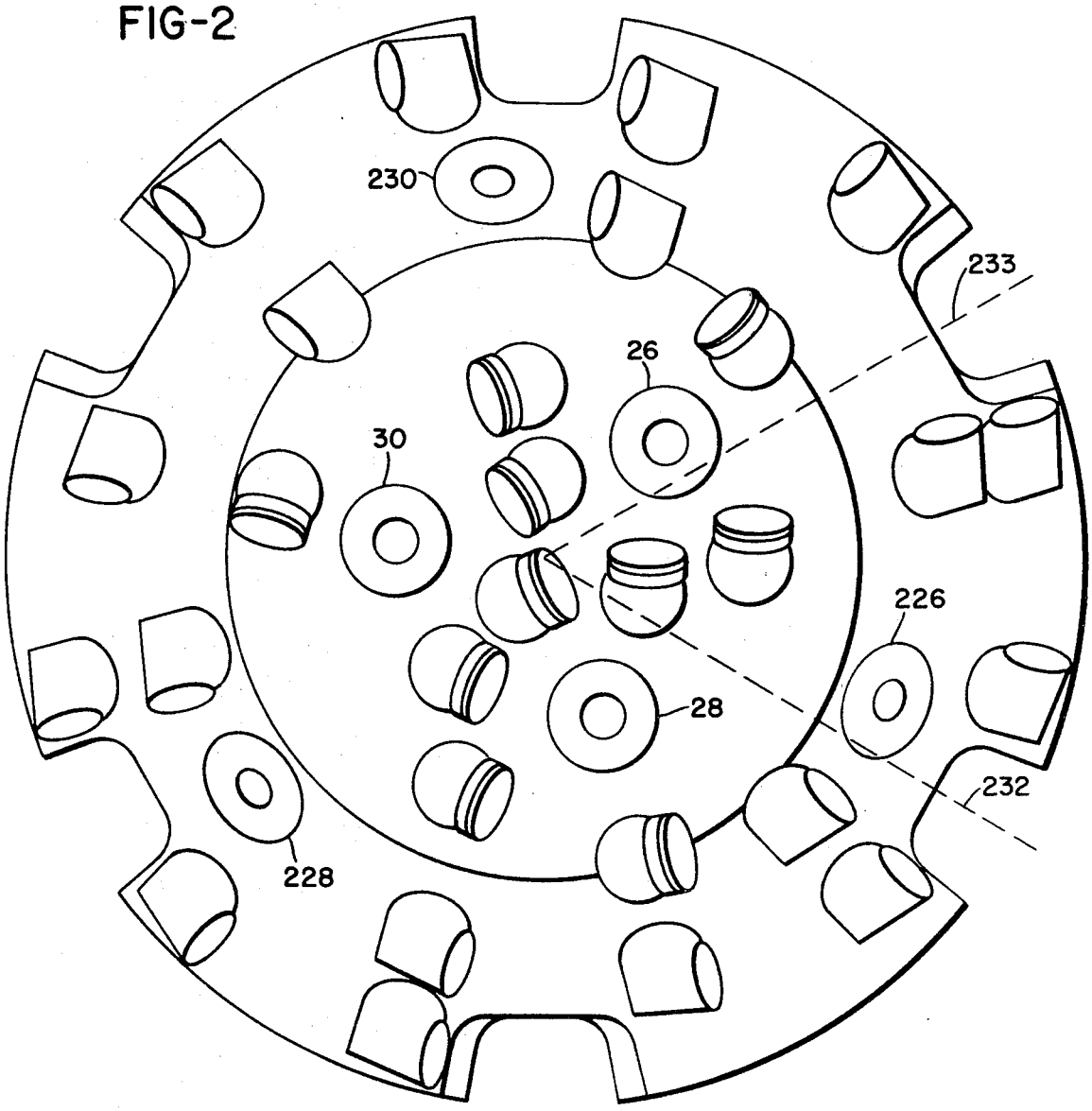
FIG. 2 is an enlarged, bottom view showing the face of the bit seen in FIG. 1.
Figure 3:
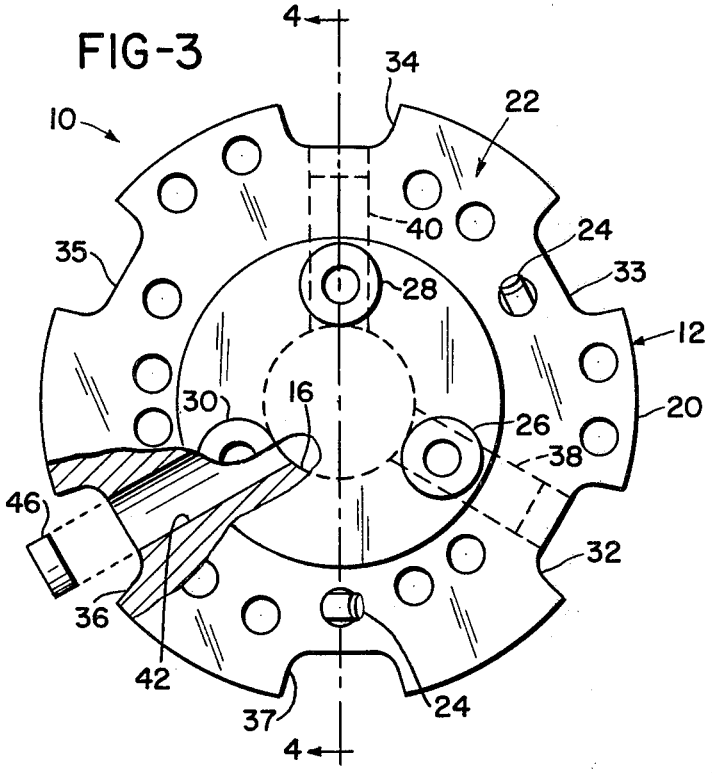
FIG. 3 is a view similar to FIG. 2, with some parts being removed therefrom in order to better illustrate part of the present invention.
Figure 4:
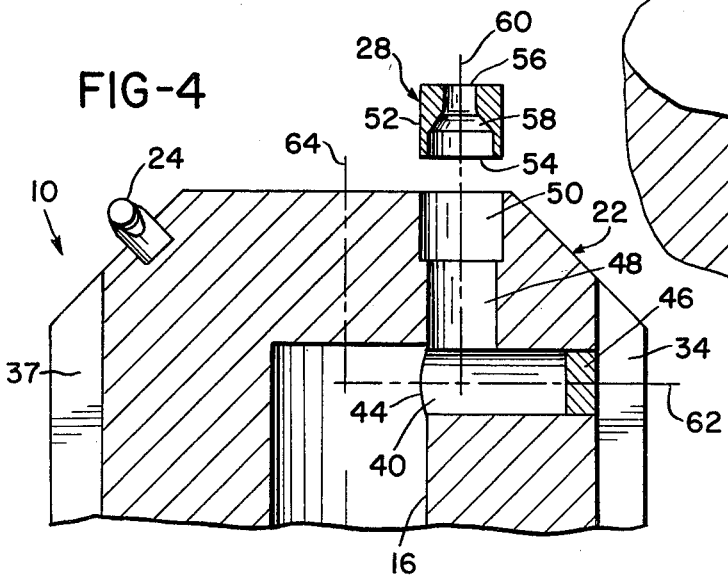
FIG. 4 is a cross-sectional view taken along line 4—4 of FIG. 3.

In the various figures of the drawings, and in particularly FIG. 1, together with FIGS. 2–4, there is disclosed a diamond drill bit 10 having a unitary body of intregal construction. The drill bit has a threaded upper marginal end 14, and an axial counterbore commencing at 16 which extends into the bit body, through which drilling fluid can be circulated. The bit enlarges to provide a bit shank at 18, and again enlarges to provide an enlarged body portion 20.

The lower end of the bit is in the form of a face 22 on which there is mounted a plurality of cutters 24 arranged in a particular pattern.

As best seen in FIGS. 1–3, together with FIG. 4, the bit includes a plurality of nozzles 26, 28, and 30 which are radially spaced from one another and extend circumferentially about the longitudinal axial centerline of the bit.

A plurality of radially spaced apart slots or grooves 32–37 are vertically arranged and are formed into the lower enlarged body portion of the bit. The grooves provide a passageway for the return of drilling fluid and formation cuttings.

As best seen illustrated in FIGS. 3 and 4, the counterbore 16 terminates in spaced relationship respective to the face of the drill bit. A plurality of lateral passageways 38, 40, and 42 extend from alternant ones of the slots 32, 34, and 36. The passageways extend radially inwardly into communication with the axial passageway 16. Each of the lateral passageways include an inlet end 44 and an outer end which is plugged at 46 to provide a blind passageway.

A nozzle passageway 48 communicates with the lateral passageway 40 and includes an outer marginal length 50 thereof made complementary respective to the outside diameter 52 of one of the nozzles 28 so that the nozzle can be affixed within the outer marginal end of the nozzle passageway and in close proximity to the bit face. The nozzle includes an inlet end 54, outlet end 56, and further includes a tapered internal throat 58 which converges in a downstream direction.

The nozzle and nozzle passageway lie along a common axial centerline 60 placed perpendicularly and intersectingly respective to the axial centerline 62 of the lateral passageway, and is placed parallel respective to the axial centerline 64 which is also the longitudinally extending axial centerline of the counterbore. Lateral passageways 38 and 42 are similarly arranged respective to a nozzle passageway leading to nozzles 26 and 30.

Figure 6:
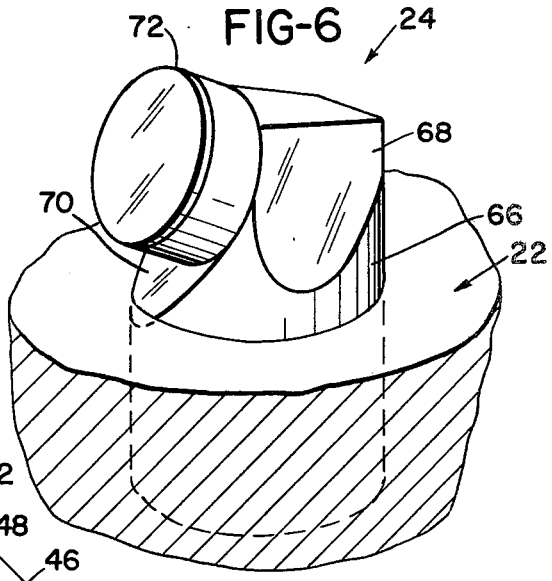

In FIG. 6, there is disclosed a polycrystalline diamond cutter assembly which comprises a stud 66 having one marginal portion thereof tightly fitted into the bit body with the remaining marginal portion thereof extending from the cutting face of the bit. The stud includes a plurality of converging sidewalls 68 which provide a flat surface at 70. A polycrystalline diamond cutter disc 72 is affixed to the surface 70.

Figure 5:
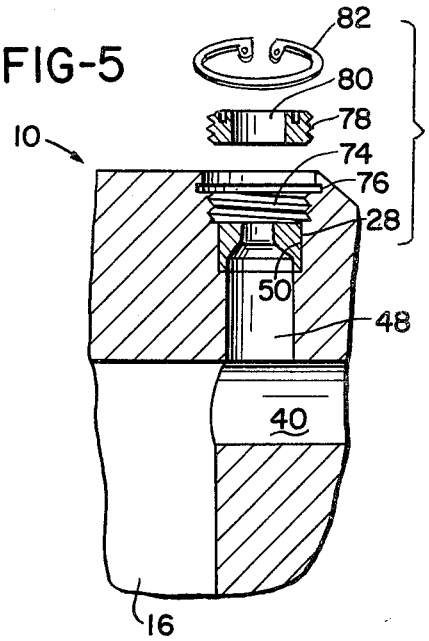
FIG. 5 sets forth the details of an alternant embodiment of the apparatus seen in some of the foregoing figures; and, FIG. 6 is an enlarged view which sets forth other details of part of the apparatus disclosed in some of the foregoing figures.

As seen illustrated in FIG. 5, the nozzle 28 is placed within the enlarged diameter portion of the nozzle passageway. The marginal length 74 of the passageway is threaded, while the outer marginal length receives a circumferentially extending groove 76. A hollow keeper 78 has an external thread made complementary respective to the female threaded surface 74. A passageway 80 is of sufficient diameter to avoid interference with flow from the nozzle outlet. Keeper 82 is received within groove 76 to prevent the jam nut from inadvertently turning.

The method of fabricating the present drill bit is best carried out by forming the main body portion by utilizing known casting methods. Alternatively, the main body can be formed by turning the bit body from solid stock such as 4140 or the like. After the counterbore 16 and the slots 32–37 have been formed, the lateral passageways 38, 40 and 42 are each drilled into the body, commencing at one of slots 34, for example, and extending the passageway such that it terminates in communication with the axial counterbore, as indicated by numeral 44 in FIG. 4, for example.

Each of the nozzle passageways, such as the nozzle passageway 48, is then formed through the face of the bit so that the inlet end of the nozzle passageway is placed in communication with the lateral passageway.

The lateral passageway is next plugged at 46 by utilizing a threaded plug, or alternatively, by welding.

The nozzles 26–30 are next installed into the outer marginal end 50 of the nozzle passageway, and the studs of the cutter members are next properly orientated respective to the face of the bit and pressed into counterbores provided at the lower marginal end of the bit.

The nozzles are pressed into the bit body with a hydraulic press by cooling the nozzles and heating the bit body, as illustrated in FIG. 4. This provides a tight fit for maintaining the nozzle in properly attached relationship respective to the bit body.

Alternatively, the nozzle may be held in proper position by the jam nut 78 and keeper 82. This form of nozzle attachment enables the nozzles to be renewed without the necessity of drilling out the old nozzle, or heating of the bit body.

The studs 66 of the cutter preferably are made of carbide, or alternatively, the exposed portion of the steel stud is coated with tungston carbide; as for example, applying the tungston carbide coating by flame spraying, plasma spraying, detonation gun, and the like.

The stud is installed by reducing the temperature thereof while the bit body is heated to about 650 degrees Fahrenheit, with the relative diameters of the stud and stud aperture being selected so that when the bit cools, the stud is rigidly held within the massive bit body. This expedient avoids heat damage to the diamonds. It also avoids the necessity of using costly electric furnaces as well as avoiding the use of silver soldering processes.

The present invention provides a unique flow passageway for the plurality of nozzles associated with the central chamber of a diamond drill bit. The provision of the intermediate connecting lateral passageway provides a means by which unrestricted nozzle placement respective to the diamond cutters can be achieved. The nozzles can be orientated in the most optimum plane and located in the most optimum position on the face of the bit respective to the plurality of cutter members.

I claim:

1. A drill bit having a body member which forms a heat at one end and connecting means at the other end, a face formed on the head in opposition to the connecting means; an axial counterbore formed within said member which upwardly opens at said connecting end, and which terminates in spaced relationship respective to said face;

a plurality of radially spaced nozzle passageways formed into said head, each nozzle passageway having an outlet which terminates at said face;

a nozzle received within the marginal terminal end of each of said nozzle passageways; means by which each said nozzle is affixed to said head and extends through said face, each said nozzle being radially spaced apart from one another and from the axial centerline of the counterbore;

a plurality of radially spaced lateral passageways formed into said head, each said lateral passageway communicates said counterbore with one of said nozzle passageways, so that drilling fluid can flow through said axial passageway, through said lateral passageways, through said nozzle passageways, and through each said nozzle;

a plurality of cutters affixed to said head in spaced relationship to one another;

said nozzle passageways each have an axial centerline aligned parallel to the axial centerline of the counterbore;

said lateral passageways are arranged perpendicular respective to the axial centerline of the counterbore;

said body member includes a plurality of radially spaced slots formed into the periphery of said head which commences at said face and continues towards said connecting means to provide external flow passageways for returning drilling fluid;

said slots are disposed parallel to said axial passageway, one of said lateral passageways extend from said axial counterbore to one of said slots; and a closure means at the outer end of the lateral passageways which is opposed to the axial counterbore.

2. The drill bit of claim 1 wherein said lateral passageways are formed from a slot into communication with said axial counterbore such that there is one said lateral passageway formed at alternant slots;

said nozzle passageways being equally spaced radially apart and from the axial centerline of the counterbore, with one of said lateral passageways connecting the inlet end of one of the nozzle passageways to the axial counterbore.

3. The drill bit of claim 2 wherein said lateral passageway has an axial centerline which intersects the axial centerline of said counterbore.

4. In a drill bit having an enlarged lower end portion, a reduced upper end portion by which the bit can be connected to a string of drill pipe, and a cutting face underlying the lower end of the lower end portion; the improvement comprising:

means forming a series of grooves circumferentially spaced about the outer surface of the lower end portion of said bit for communicating the area below the bit face with the reduced upper end portion during a drilling operation; an axial counterbore formed into the interior of the bit for conducting drilling fluid from a drill string to the cutting face; a plurality of cutters affixed to said bit and extending from said cutting face; a plurality of nozzles affixed to said bit and extending from said cutting face;

a lateral passageway extending radially outward from said axial counterbore to one of said grooves, a closure means at the end of the lateral passageway adjacent said one of said grooves;

a nozzle passageway for each nozzle, each said nozzle passageway has one end which terminates in communication with said lateral passageway, with the other end of said nozzle passageway being in communication with said nozzle;

said lateral passageway has an axial centerline which intersects the axial centerline of said counterbore; said lateral passageway is formed from said groove, through said lower end portion, and into communication with said axial counterbore such that there is one said lateral passageway formed at alternant grooves; said nozzle passageways being equally spaced radially apart and from the axial centerline of the counterbore, with one said lateral passageway connecting the inlet end of a nozzle passageway to the axial counterbore;

said nozzle passageways being placed circumferentially about the longitudinal axial centerline of the bit counterbore and parallel thereto.

* * * * *